US009004273B2

(12) United States Patent
Tanbo

(10) Patent No.: US 9,004,273 B2
(45) Date of Patent: Apr. 14, 2015

(54) HINGE-LID PACK FOR ROD-SHAPED SMOKING ARTICLES AND A BLANK THEREFOR

(75) Inventor: Hitoshi Tanbo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 790 days.

(21) Appl. No.: 11/826,193

(22) Filed: Jul. 12, 2007

(65) Prior Publication Data

US 2008/0011627 A1 Jan. 17, 2008

Related U.S. Application Data

(63) Continuation of application No. PCT/JP2006/300220, filed on Jan. 11, 2006.

(30) Foreign Application Priority Data

Jan. 14, 2005 (JP) ..... 2005-007839

(51) Int. Cl.
*B65D 85/10* (2006.01)
*B65D 5/54* (2006.01)
*B65D 5/66* (2006.01)

(52) U.S. Cl.
CPC ..... *B65D 85/1045* (2013.01); *B65D 5/5425* (2013.01); *B65D 5/6685* (2013.01)

(58) Field of Classification Search
CPC .... B65D 5/5425; B65D 5/6685; B65D 5/543; B65D 5/6608; B65D 5/4266; B65D 85/1045; B65D 85/1036; B65D 77/042; A24F 15/12
USPC ..... 206/268, 273; 229/149–151, 160.1, 237
See application file for complete search history.

(56) References Cited

U.S. PATENT DOCUMENTS

| | | | | | |
|---|---|---|---|---|---|
| 3,036,755 | A | | 5/1962 | Stone | |
| 3,076,590 | A | | 2/1963 | Petryk et al. | |
| 3,833,165 | A | | 9/1974 | Hoiles | |
| 4,889,278 | A | * | 12/1989 | Steidinger | 229/92.1 |
| 4,949,841 | A | * | 8/1990 | Focke et al. | 206/273 |
| 4,982,845 | A | * | 1/1991 | Prascak et al. | 229/237 |
| 5,042,653 | A | | 8/1991 | Ems | |
| 5,301,804 | A | * | 4/1994 | Focke et al. | 206/273 |
| 5,462,223 | A | * | 10/1995 | Focke et al. | 229/160.1 |
| 5,749,462 | A | * | 5/1998 | Houghton | 206/268 |
| 5,896,984 | A | * | 4/1999 | Focke et al. | 206/268 |
| 7,353,940 | B2 | * | 4/2008 | Sendo | 206/268 |

FOREIGN PATENT DOCUMENTS

| | | | |
|---|---|---|---|
| JP | 51-150915 | A | 12/1976 |
| JP | 9-142523 | A | 6/1997 |
| RU | 98119675 | A | 9/2000 |
| RU | 99106799 | A | 2/2001 |
| RU | 2 218 296 | C2 | 12/2003 |
| WO | WO-2004/064550 | A1 | 8/2004 |

* cited by examiner

*Primary Examiner* — Andrew Perreault
(74) *Attorney, Agent, or Firm* — Birch, Stewart, Kolasch & Birch, LLP

(57) ABSTRACT

A tongue-lid package of the present invention has an outer box (2). A separation line (70) demarcating a U-shaped to-be-cut-off portion (72) is formed in a front wall (20) of the outer box (2). The separation line (70) includes right- and left-side perforated lines (80, 82) that form a part of both sides of the to-be-cut-off portion (72). The perforated lines have a plurality of perforations (84) and intermediate portions (86) between the cuts (84). The intermediate portions (86) of the right- and left-side perforated lines are arranged asymmetrically to axis X of the to-be-cut-off portion (72).

6 Claims, 8 Drawing Sheets

HINGE-LID PACK FOR ROD-SHAPED SMOKING ARTICLES AND A BLANK THEREFOR

This application is a Continuation of copending PCT International Application No. PCT/JP2006/300220 filed on Jan. 11, 2006, which designated the United States, and on which priority is claimed under 35 U.S.C. §120. This application also claims priority under 35 U.S.C. §119(a) on Patent Application No(s). 2005-007839 filed in Japan on Jan. 14, 2005. The entire contents of each of the above documents is hereby incorporated by reference.

TECHNICAL FIELD

The present invention relates to a hinge-lid package for rod-shaped smoking articles such as cigarettes and filter cigarettes, and to a blank for forming an outer shell of the package.

BACKGROUND ART

Among this type of hinge-lid packages for rod-shaped smoking articles, a tongue-lid package as disclosed, for example, in International Publication WO 2004/064550 is well known. This package disclosed in the publication comprises an outer box in which an inner pack of rod-shaped smoking articles is contained. The outer box includes an open end and a tongue lid for opening/closing the open end thereof. The tongue lid is hingedly jointed to the rear edge of the open end, and has a lid for covering the open end and a tongue extending from the lid. Immediately after the tongue-lid package is fabricated, the tongue is superposed upon a part of a front wall of the outer box.

Specifically, the front wall has a substantially U-shaped separation line. The separation line demarcates a to-be-cut-off portion in a part of the front wall. The to-be-cut-off portion partially includes the front edge of the open end. Right after the fabrication of the package, the to-be-cut-off portion of the front wall is bonded to the inner surface of the tongue with adhesive.

Therefore, when the tongue of the tongue lid is pulled up from the front wall of the outer box to open the tongue-lid package for the first time, this separates the to-be-cut-off portion from the front wall along the separation line. As a result, the tongue lid is allowed to turn around the hinge, which makes it possible to open the open end of the outer box.

The separation of the to-be-cut-off portion forms a substantially U-shaped cut area in the front wall and simultaneously forms a separated piece corresponding to the to-be-cut-off portion. In the case of a conventional hinge-lid package, such a cut area corresponds to that of the inner frame of the package, and makes it easy to take a filter cigarette out of the package. The separated piece is kept in a position bonded to the tongue lid, so that it does not become a scrap detached from the outer box.

When the tongue lid is closed after being opened, the tongue of the tongue lid that closes the open end of the outer box is superposed upon the front wall of the outer box. At this time, the tip end of the tongue is inserted into the outer box through a slit formed in the front wall, which maintains the tongue lid in the closed position. The slit is previously formed in the front wall and is covered with the tongue of the tongue lid until the tongue-lid package is first opened.

The U-shaped separation line for demarcating the to-be-cut-off portion is formed of a perforated line, which includes a large number of perforations. These perforations are arranged at regular intervals along the separation line. To be more concrete, the perforations of the separation line are distributed symmetrically with respect to the center line that divides the to-be-cut-off portion into two symmetrical parts.

When the tongue is pulled up from the front wall of the outer box to open the tongue lid for the first time, the to-be-cut-off portion is separated from the front wall of the outer box along the separation line as stated above. There is no fixed position in the separation line to start ripping.

For that reason, it is very difficult to accurately and reliably separate the to-be-cut-off portion from the front wall of the outer box along the separation line. In some cases, there remains a part of the to-be-cut-off portion in the front wall, or a crack appears in the edge of the cut area when the cut area is formed in the front wall.

It is an object of the present invention to provide a hinge-lid package for rod-shaped smoking articles which allows to finely and reliably form a cut area in the front wall of an outer box when a tongue lid is first opened, and which does not disfigure the outer box in an open position, and a blank therefor.

DISCLOSURE OF THE INVENTION

In order to accomplish the above-mentioned object, a hinge-lid package for rod-shaped smoking articles according to the present invention comprises an outer box having an open end; an inner pack contained in the outer box, the inner pack including a bundle of the rod-like smoking articles and an inner wrapper wrapping the bundle; a lid hingedly jointed to a rear edge of the open end of the outer box, the lid for opening and closing the open end; and a separation line for detachably connecting the outer box and the lid, the separation line including a fragile portion for determining a cutoff start position to start the cutting thereof when the lid is first opened.

When the lid is opened for the first time, the separation line is torn from the fragile portion. With this rupture as a trigger, the lid is reliably and cleanly detached from the outer box along the separation line and becomes turnable around a hinge.

More specifically, the separation line demarcates a to-be-cut-off portion having a substantially U-like shape in a front wall of the outer box. The to-be-cut-off portion includes a part of a front edge of the open end of the outer box, and is in a position bonded to an inner surface of the lid until the lid is first opened. In this case, when the lid is opened for the first time, the to-be-cut-off portion is detached from the front wall of the outer box along the separation line. As a result, a cut area having a substantially U-like shape is reliably and finely formed in the front wall. This cut area makes it easy to access the inner pack contained in the outer box.

The separation line may include a pair of perforated lines forming a part of straight lateral sides of the U-shaped to-be-cut-off portion. The perforate lines have perforations spaced from each other along the lateral sides and intermediate portions between the perforations. The intermediate portions of the perforated lines are arranged asymmetrically to each other with respect to an axis passing through a center of the to-be-cut-off portion. In this case, when the lid is first opened, the intermediate portions of the perforated lines are torn, but not at the same time.

To be more specific, the separation line may further include a base slit forming a bottom of the U-shaped to-be-cut-off portion. In this case, one of areas between the base slit and the perforated lines is formed as the fragile portion. Preferably, the intermediate portions of the perforated lines which are located farther from the base slit have proportionally longer lengths.

The lid may have a tongue superposed upon the front wall of the outer box and bonded to the to-be-cut-off portion immediately after the hinge-lid package is fabricated. In this case, the package of the present invention is a tongue-lid package.

In the case of the above-mentioned tongue-lid package, the lid may further include a pair of lugs superposed upon and bonded to both side walls of the outer box immediately after the hinge-lid package is fabricated, and second separation lines for detachably connecting the lugs and the lid.

In this case, when the tongue lid is opened for the first time, each lug is easily and cleanly detached from the tongue. After the detachment of the lugs, breaking marks are left in both the lugs and the tongue, which are exposed outside the hinge-lid package. The breaking marks effectively function as tamper prevention on the inner pack contained in the hinge-lid package.

The outer box may further include a pair of inner top flaps superposed upon and bonded to the inner surface of the lid immediately after the hinge-lid package is fabricated, and third separation lines for detachably connecting the inner top flaps to both side edges of the open end of the outer box. When the lid is first opened, the inner top flaps are easily and cleanly detached from the outer box along the third separation lines.

The present invention provides a blank for forming the outer box and the lid of the above-described hinge-lid package.

BEST MODE OF CARRYING OUT THE INVENTION

Figure 1:
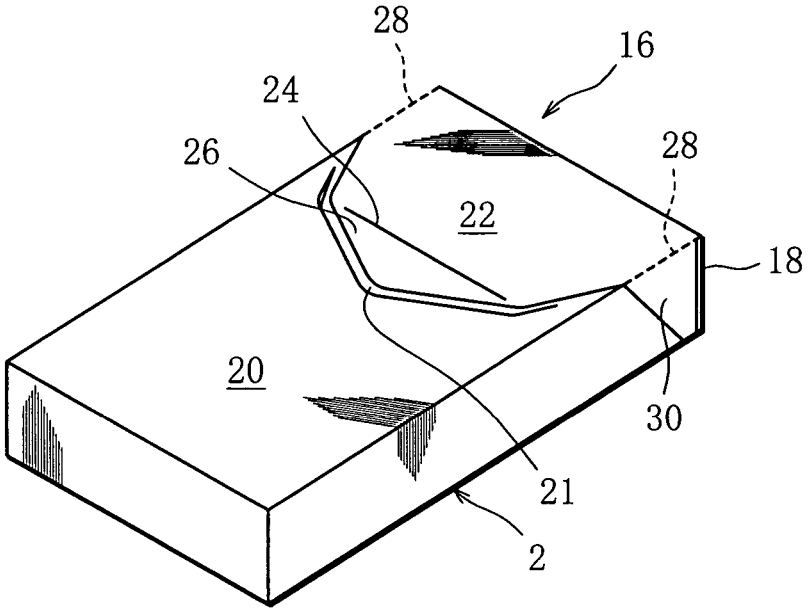
FIG. 1 is a perspective view showing a tongue-lid package in a closed position.
Figure 2:
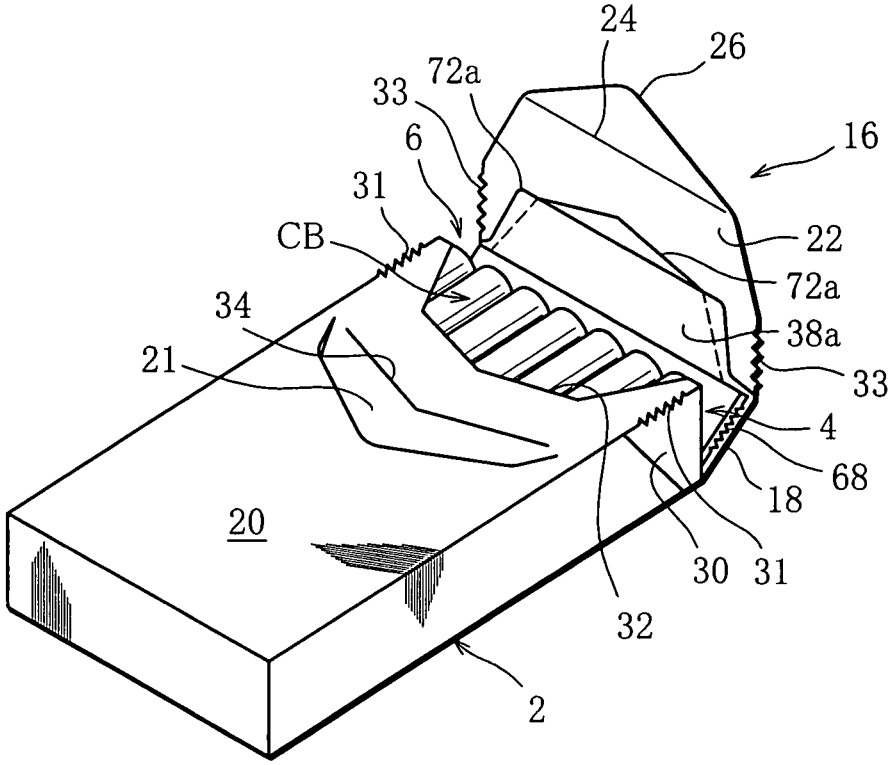
FIG. 2 is a perspective view showing the tongue-lid package in an open position.

FIGS. 1 and 2 show a tongue-lid package for filter cigarettes.

This package includes an outer box 2, whose upper end is formed into a rectangular open end 4. An inner pack 6 is contained in the outer box 2. The inner pack 6 includes a cigarette bundle CB and an inner wrapper in which the cigarette bundle CB is wrapped. The cigarette bundle CB has twenty filter cigarettes.

The tongue-lid package further includes a tongue lid 16. The tongue lid 16 is hingedly jointed to a rear edge of the open end 4 and opens and closes the open end 4. When in a closed position, the tongue lid 16 has a lid 18 covering the open end 4 and a tongue 22 extending from the lid 18. The tongue 22 and the lid 18 are demarcated from each other by a fold line 19.

When the tongue-lid package is fabricated, the tongue 22 is superposed upon a front wall 20 of the outer box as illustrated in FIG. 1. The tongue 22 has an insertion tip 26 in a distal end portion thereof. The insertion tip 26 and a base portion of the tongue 22 are demarcated from each other by a bend line 24. In the present embodiment, the base portion of the tongue 22 has width that is tapered toward the insertion tip 26. The insertion tip 26 is also tapered toward the distal end thereof.

In the front wall 20 of the outer box 2, there is formed a push-in dent 21 by press work. The push-in dent 21 has a similar shape to the tip end portion of the tongue 22 and is capable of receiving the insertion tip 26 of the tongue 22. The push-in dent 21 has depth that is gradually increased toward a bottom wall of the outer box 2. Therefore, when the tongue 22 is received by the push-in dent 21 of the front wall 20, the push-in dent 21 causes the insertion tip 26 of the tongue 22 to sink into the front wall 20.

Figure 3:
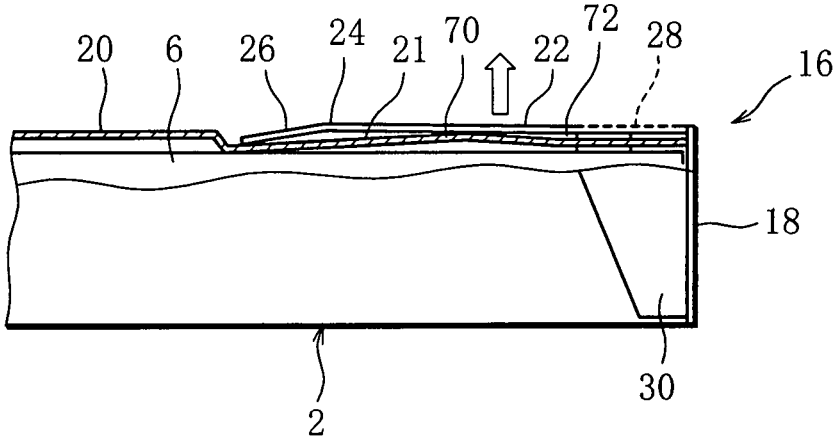
FIG. 3 is a side view showing the package of FIG. 1, partially broken away.

In the present embodiment, as is apparent from FIG. 3, the insertion tip 26 is bent along the bend line 24 and is in a posture directed to a bottom of the push-in dent 21. Accordingly, the insertion tip 26 is in contact with the bottom of the push-in dent 21.

Lugs 30 are connected to both side edges of the tongue 22 through second separation lines 28. The second separation lines 28 are shown by dashed lines in FIGS. 1 and 3. When the tongue-lid package is fabricated, the lugs 30 are bonded to respective side walls of the outer box 2. When the tongue lid 16 is opened for the first time, however, the tongue 22 is separated from the lugs 30 along the second separation lines 28. As illustrated in FIG. 2, traces 31 and 33 are left in the tongue 22 and the lugs 30. The traces 31 and 33 indicate that the tongue lid 16 has already been opened.

As is obvious from FIG. 2, when the tongue lid 16 is opened, a U-shaped cut area 32 is formed in the front wall 20 of the outer box 2. The cut area 32 extends from the open end 4 of the outer box 2. Simultaneously with the formation of the cut area 32, a part of an inner wrapper 9 of the inner pack 6, which corresponds to the cut area 32, is cut away. As a result, a part of the cigarette bundle CB in the inner pack 6 is exposed through the cut area 32. This makes it easy to taken a filter cigarette in the inner pack 6 out of the outer box 2 through the cut area 32.

When the tongue lid 16 is opened, as illustrated in FIG. 2, an insertion slit 34 is exposed in the front wall 20 of the outer box 2. The insertion slit 34 is formed beforehand in the front wall 20. Until the tongue lid 16 is opened for the first time, the insertion slit 34 is in a position covered with the tongue 22 of the tongue lid 16. More specifically, the insertion slit 34 is located in a base portion of the push-in dent 21, that is, a portion where the push-in dent 21 starts appearing (a portion in which the depth of the push-in dent 21 is shallow).

As is evident from FIG. 2, the insertion slit 34 is formed in the shape of the letter V splayed toward the cut area 32. Therefore, when the tongue lid 16 is closed after being opened, the insertion tip 26 of the tongue lid 16 can be inserted into the outer box 2 through the insertion slit 34 without difficulty. When the insertion tip 26 is inserted into the insertion slit 34, the insertion tip 26 is sandwiched between the front wall 20 and the inner pack 6, and the tongue lid 16 is maintained in a closed position. The insertion slit 34 may be formed in a shape of a circular arc whose concave side faces the cut area 32 instead of the V-like shape.

Figure 4:
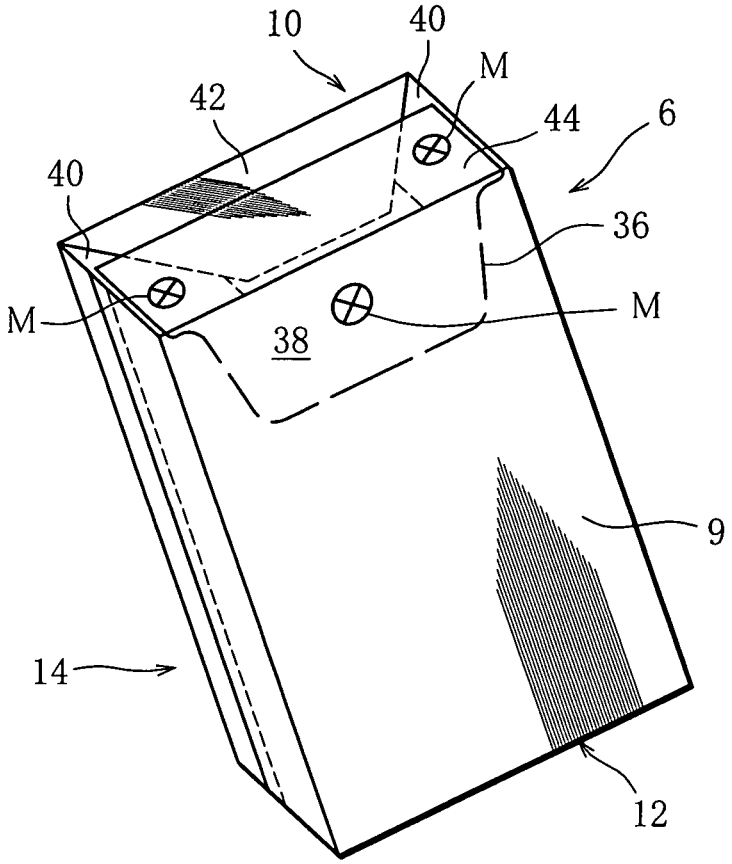
FIG. 4 is a perspective view showing an inner pack contained in the package of FIGS. 1 and 2.

FIG. 4 shows the inner pack 6 in detail.

The inner pack 6 has an upper face 10 and a bottom face 12. The upper face 10 and the bottom face 12 are formed by folding the inner wrapper 9. One side face 14 of the inner pack 6 is formed by superposing both ends of the inner wrapper 9.

In order to enable separation of the inner wrapper 9, the inner wrapper 9 has a U-shaped separation line 36 corresponding to the cut area 32 as illustrated in FIG. 4. The separation line 36 is located on the side of the upper face 10 of the inner pack 6. The separation line 36 demarcates a to-be-detached portion 38 in the inner wrapper 9. The to-be-detached portion 38 includes a part of the inner wrapper 9 forming the upper face 10 of the inner pack 6. To be more concrete, as is apparent from FIG. 4, a portion of the inner wrapper 9, which forms the upper face 10, includes right and left end flaps 40, and an inner flap 42 and an outer flap 44 superposed upon the end flaps 40 in order. The to-be-detached portion 38 includes the outer flap 44.

The inner wrapper 9 has a triple layer structure and includes two paper layers 11 forming inner and outer surfaces and a shielding layer 13 sandwiched between the paper layers 11. Each of the paper layers 11 is made of glassine paper, and the shielding layer 13 paraffin wax. The shielding layer 13 not only protects the cigarette bundle CB contained in the inner pack 6 from outside moisture but also prevents flavor and aroma from escaping from the cigarette bundle CB. Therefore, the tongue-lid package of the present embodiment does not need film wrapping with tear tape for covering the outer box 2 and the tongue lid 1.

When the tongue lid 16 is first opened, the traces 31 and 33 are left in the lugs 30 and the tongue 22, respectively, as described above. The traces 31 and 33 are visible from outside the tongue-lid package, so that they effectively function as tamper prevention on the cigarette bundle CB of the inner pack 6 as with the tear tape of the film wrapping.

Figure 5:
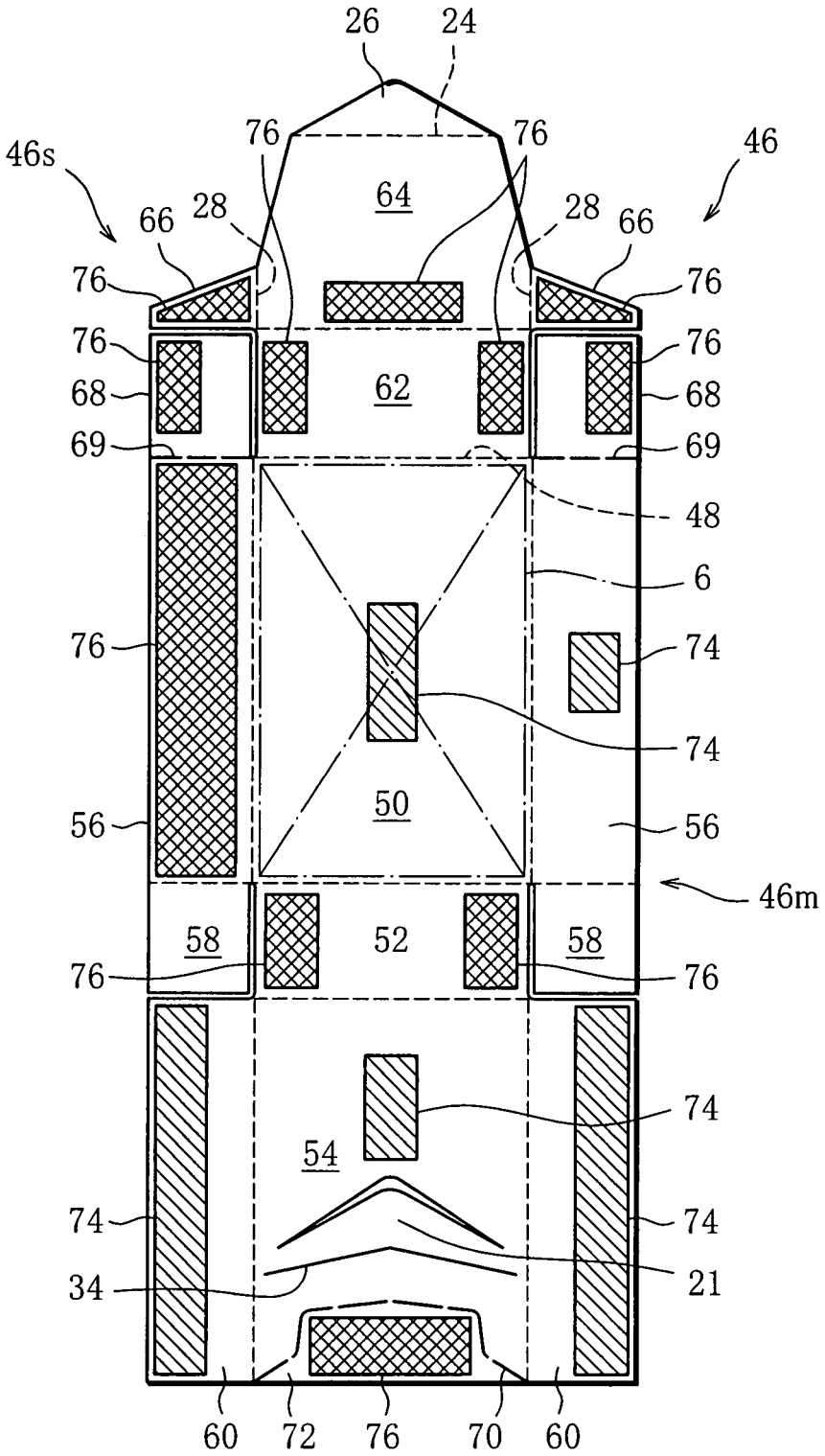
FIG. 5 is a view showing a blank for forming an outer box of the package of FIGS. 1 and 2.

FIG. 5 shows a blank 46 for forming the outer box 2 and the tongue lid 16, or a inner surface of the blank 46.

The blank 46 includes a main section **46*m* for forming the outer box 2 and a subsection 46*s* for forming the tongue lid 16. The sections 46*m* and 46*s* are arranged side by side in a longitudinal direction of the blank 46 and connected to each other by a fold line 48 shown by a dashed line. The fold line 48 forms the hinge. In respect of the following description, other fold lines are also shown by dashed lines in FIG. 7**.

The main section **46*m* has three panels. These panels are aligned in order in a longitudinal direction of the main section 46 and are demarcated by fold lines. More specifically, the panels include a rear panel 50, an outer bottom panel 52 and a front panel 54 in the order named from the subsection 46*s* side. The rear panel 50 and the front panel 54 form a rear wall and the front wall 20 of the outer box 2, respectively. When the tongue-lid package is fabricated, the outer bottom panel 52 forms a part of the bottom wall of the outer box 2**.

Inner side flaps 56 are connected to both side edges of the rear panel 50 through fold lines. Inner bottom flaps 58 are connected to lower edges of the inner side flaps 56 through fold lines. The inner bottom flaps 58 are disposed on both sides of the outer bottom panel 52. When the tongue-lid package is fabricated, the inner bottom flaps 58 form the bottom wall of the outer box 2 with the outer bottom panel 52.

Outer side flaps 60 are connected to both side edges of the front panel 54 through fold lines. When the tongue-lid package is fabricated, the outer side flaps 60 form side walls of the outer box 2 with the respective inner side flaps 56.

The subsection **46*s* includes a lid panel 62 and a tongue panel 64. The panels 62 and 64 are arranged in the order named from the rear panel 50 side. The lid panel 62 is connected to the rear panel 50 through the fold line, while the tongue panel 64 is connected to the lid panel 62 through a fold line. The tongue panel 64 has a bend line 24. When the tongue-lid package is fabricated, the bend line 24 forms a distal end portion of the tongue panel 64 as the insertion tip 26. Lug flaps 66 are connected to both side edges of the tongue panel 64 through the second separation lines 28. The lug flaps 66 form the lugs 30** when the tongue-lid package is fabricated.

Inner top flaps 68 are disposed on both sides of the lid panel 62. The inner top panels 68 are connected to upper edges of the respective inner side flaps 56 through separation lines 69. When the tongue-lid package is fabricated, the inner top flaps 68 form the lid 18 with the lid panel 62.

The front panel 54 has a first separation line 70 in addition to the insertion slit 34. The first separation line 70 is formed in a substantially U-like shape and demarcates a to-be-cut-off portion 72 in a lower edge portion of the front panel 54.

The front panel 54 has the push-in dent 21. As is evident from the foregoing description, the push-in dent 21 is protruding from the inner surface of the front panel 54 like a relief.

The inner surface of the blank 46 is applied with glue at predetermined places. Glue-applied areas 74 are shown by hatched patterns in FIG. 5. When the tongue-lid package is fabricated, that is, when the blank 46 is folded around the inner pack 6, the glue-applied areas are used for connection between the panels and the flaps, connection between the flaps or connection of the panels and the flaps with respect to the inner pack 6.

The glue-applied areas 74 are provided to a blank for a conventional package. The blank 46 for the tongue-lid package of the present invention further has glue-applied areas 76 other than the glue-applied areas 74. The glue-applied areas 76 are shown by cross-hatched patterns in FIG. 5. More specifically, the glue-applied areas 76 are formed in the to-be-cut-off portion 72, both side portions of the outer bottom panel 52, one of the inner side flaps 56, both side portions of the lid panel 62, the pair of inner top flaps 68 and the pair of lug flaps 66.

Functions of the glue-applied areas 76 will be become clear from a fabrication process of the tongue-lid package which will be described with reference to FIGS. 6 to 8.

Figure 6:
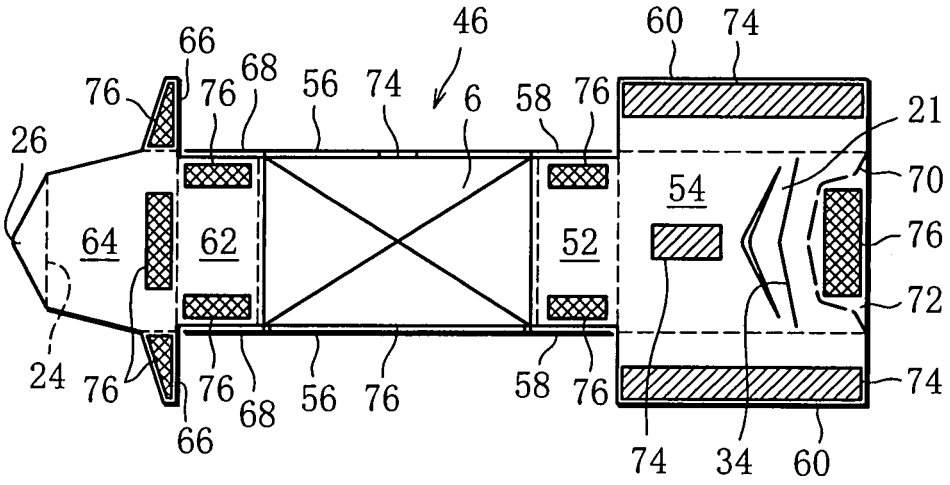
FIG. 6 is a view showing a folding process of the blank of FIG. 5.

First, as illustrated in FIG. 6, the inner pack 6 is placed on the inner surface of the blank 46, namely the rear panel 50, and is bonded to the rear panel 50 by the glue-applied area 74. Subsequently, the pair of inner side flaps 56 is folded against respective side faces of the inner pack 6 and bonded to the inner pack 6 by the glue-applied areas 74 and 76. Due to the folding work of the inner side flaps 56, the inner bottom flaps 58 and the inner top flaps 68 connected to both ends of the inner side flaps 56 are parallelized with the respective side faces of the inner pack 6.

One of the inner side flaps 56 having the glue-applied area 76 is bonded to the one side face 14 (see FIG. 4) of the inner pack 6 and seals the one side face 14 of the inner pack 6. In other words, both the ends of the inner wrapper 9 which are superposed upon each other to form the one side face 14 are bonded to the inner side flap 56 by the glue-applied area 76 over the entire longitudinal area of the inner pack 6. Therefore, the inner pack 6 is enhanced in sealability.

Figure 7:
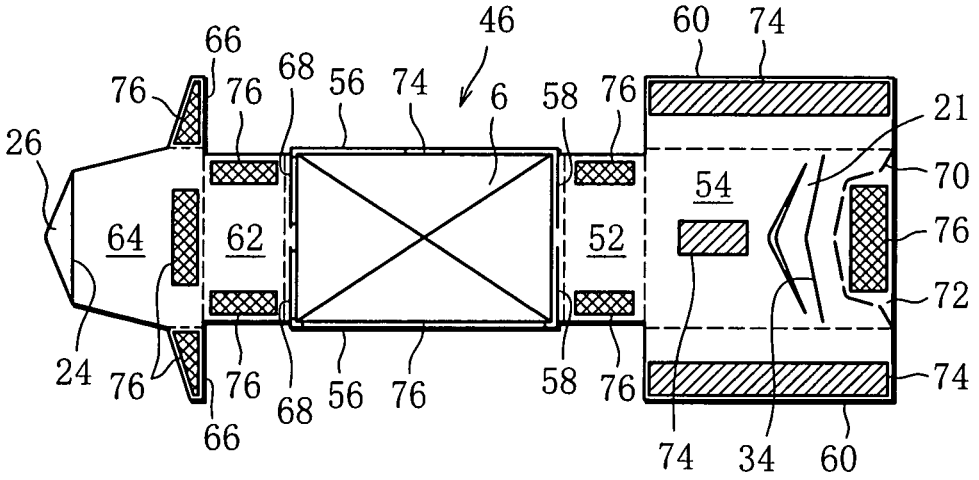
FIG. 7 is a view showing a state in which the folding work of the blank further proceeds from the state shown in FIG. 6.

Thereafter, as illustrated in FIG. 7, the pair of inner bottom flaps 58 is folded against the bottom face of the inner pack 6. At the same time as the folding work, the inner top flaps 68 are folded along the separation lines 69 (see FIG. 5) against the upper face 10 of the inner pack 6 (see FIG. 4). Since the inner top flaps 68 have the glue-applied areas 76, the inner top flaps 68 are bonded to the upper face 10 of the inner pack 6, namely both the end portions of the outer flap 44 forming the upper face 10, by the glue-applied areas 76. Bonding positions of the inner top flaps 68 and the outer flap 44 are shown by mark M in FIG. 4.

Simultaneously with the folding work of the flaps 58 and 68, the insertion tip 26 of the tongue panel 64 is bent along the bend line 24 and is slightly raised toward the inner pack 6.

Figure 8:
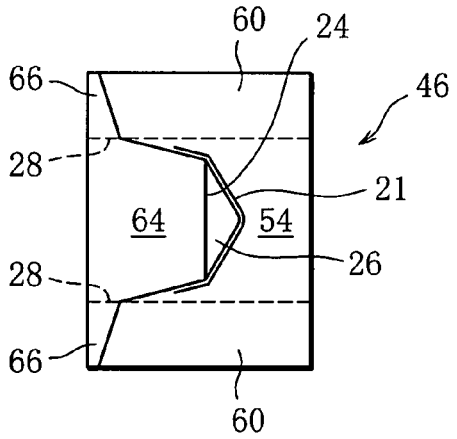
FIG. 8 is a view showing a state in which the folding work of the blank further proceeds from the state shown in FIG. 7.

Subsequently, as illustrated in FIG. 8, the outer bottom panel 52 is folded toward the bottom face of the inner pack 6 along with the front panel 54. The outer bottom panel 52 is bonded to the folded inner bottom flaps 58 by the pair of glue-applied areas 76. At this point of time, the bottom wall of the outer box 2 is produced.

The pair of inner bottom flaps 58 and the outer bottom panel 52 which form the bottom wall of the outer box 2 are bonded to each other by the glue-applied areas 76. This improves sealability of the outer box 2 with respect to the inner pack 6.

Thereafter, the front panel 54 is folded against the inner pack 6 along with the pair of outer side flaps 60 and bonded to a front face of the inner pack 6 by the glue-applied area 74. At the same time as this bonding work, the to-be-cut-off portion 72 of the front panel 54 is bonded to the to-be-detached portion 38 of the inner wrapper 9 in the inner pack 6 by the glue-applied area 76. A bonding position of the to-be-cut-off portion 72 and the to-be-detached portion 38 is shown by a mark M in FIG. 4.

Upon completion of the folding work of the front panel 54, the lid panel 62 is folded toward the inner pack 6 along with the tongue panel 64 and bonded to the folded inner top flaps 68 by the glue-applied areas 76. At this point of time, the inner top flaps 68 and the lid panel 62 form the lid 18 of the tongue lid 16.

It should be noted that the lid panel 62 is bonded to the to-be-detached portion 38 of the inner pack 6 (outer flap 44) through the pair of inner top flaps 68, and that the inner top flaps 68 are detachable from the respective inner side flaps 56 along the separation lines 69.

In the next place, as illustrated in FIG. 8, the tongue panel 64 is folded toward the front panel 54 that has already been folded, and is superposed upon the front panel 54. At this point, the tongue panel 64 covers the insertion slit 34 of the front panel 54, and the insertion tip 26 of the tongue lid 74 is received in the push-in dent 21 in a position fitted to the push-in dent 21. Since the insertion tip 26 is already in the bent posture as described, the distal end of the insertion tip 26 is brought into contact with the bottom of the push-in dent 21 (see FIG. 3).

The tongue panel 64 is bonded to the to-be-cut-off portion 72 of the front panel 54 by the glue-attached area 76. The lug flaps 66 of the tongue panel 64 are superposed upon the respective outer side flaps 60 of the front panel 54.

Since the to-be-cut-off portion 72 is already bonded to the to-be-detached portion 38 of the inner pack 6 as described, the tongue panel 64 is bonded to the to-be-detached portion 38 with the to-be-cut-off portion 72 intervening therebetween.

Subsequently, from the state shown in FIG. 8, the outer side flaps 60 of the front panel 54 are folded toward the respective side faces of the inner pack 6 along with the lug flaps 68. The outer side flaps 60 are superposed upon the respective inner side flaps 56 that have already been folded, and are bonded to the inner side flaps 56 by the glue-applied areas 74. Upon the formation of both the side walls of the outer box 2, the tongue-lid package (see FIG. 1) is completed. The tongue-lid package has the lugs 30 in both the side walls of the outer box.

The above-described folding procedure of the blank 46 is virtually the same as that of a conventional blank. Therefore, the tongue-lid package of the present invention can be fabricated simply by adding a glue applicator, not shown, for forming the glue-applied areas 76 to a conventional packing machine.

When the tongue-lid package of FIG. 1 is first opened, the tongue 22 of the tongue lid 16 is raised from the insertion tip 26 side. As the tongue 22 is raised, the to-be-cut-off portion 72 is cut away from the front wall 10 of the outer box 2 along the first separation line 70, and at the same time, the to-be-detached portion 38 of the inner wrapper 9 is cut off along the separation line 36.

When the tongue 22 is further raised, the tongue 22 is detached from the pair of lugs 30 along the second separation lines 28. The inner top flaps 68 forming the lid 18 are then cut away from the respective inner side flaps 56 along the third separation lines 69 (see FIG. 1).

Since the lugs 30 are exposed outside of the outer box 2 as stated, after the tongue 22 is cut off from the lugs 30, this leaves the traces 31 and 33 in both the outer box 2 and the lid 22. The traces 31 and 33 serve as indexes indicating that the tongue-lid package has already been opened. Therefore, the lugs 30 effectively function as tamper prevention.

After the tongue 22 is detached from the lugs 30, it is possible to widely turn the tongue lid 16 around the hinge (fold line 48). When the tongue lid 16 is made to widely turn in this manner, the to-be-cut-off portion 72 is cut off from the front wall 10 of the outer box 2, to thereby form the cut area 32 in the front wall 10. The to-be-detached portion 38 is then cut away from the inner wrapper 9 in the inner pack 6. Therefore, as illustrated in FIG. 2, a part of the cigarette bundle CB contained in the inner pack 6 is exposed through the cut area 32. Furthermore, a part of an upper end of the cigarette bundle CB is also exposed from the upper face 10 of the inner pack 6. This makes it easy to access the filter cigarettes in the inner pack 6.

After being cut off, the to-be-cut-off portion 72 and the to-be-detached portion 38 form a cut piece 72*a* and a detached piece 38*a*, respectively. The cut piece 72*a* and the detached piece 38*a* are bonded together by the glue-applied area 76, and moreover the cut piece 72*a* is bonded to the inner surface of the tongue 32 by the glue-applied area 76. Therefore, the cut piece 72*a* and the detached piece 38*a* are maintained in a position bonded to the inner surface of the tongue 32 as illustrated in FIG. 2. The cut piece 72*a* and the detached piece 38*a* never stick out from the tongue lid 16. As a result, it is not required to dispose of the cut piece 72*a* and the detached piece 38*a* when the tongue-lid package is first opened. In later time, the cut piece 72*a* and the detached piece 38*a* are discarded with the tongue-lid package.

The outer flap 44 of the to-be-detached portion 38 is bonded to the inner top flaps 68 by the glue-applied portions 76 as described. Accordingly, the cutout of the to-be-detached portion 38 which involves the turning operation of the tongue lid 16 can be smoothly carried out.

In order to accurately and cleanly detach the to-be-cut-off portion 72, the lugs 30 and the inner top flap 68 when the tongue lid 16 is opened, the first to third separation lines 70, 28 and 69 have unique configurations. These unique configurations will be explained below with reference to FIGS. 9 to 11.

Figure 9:
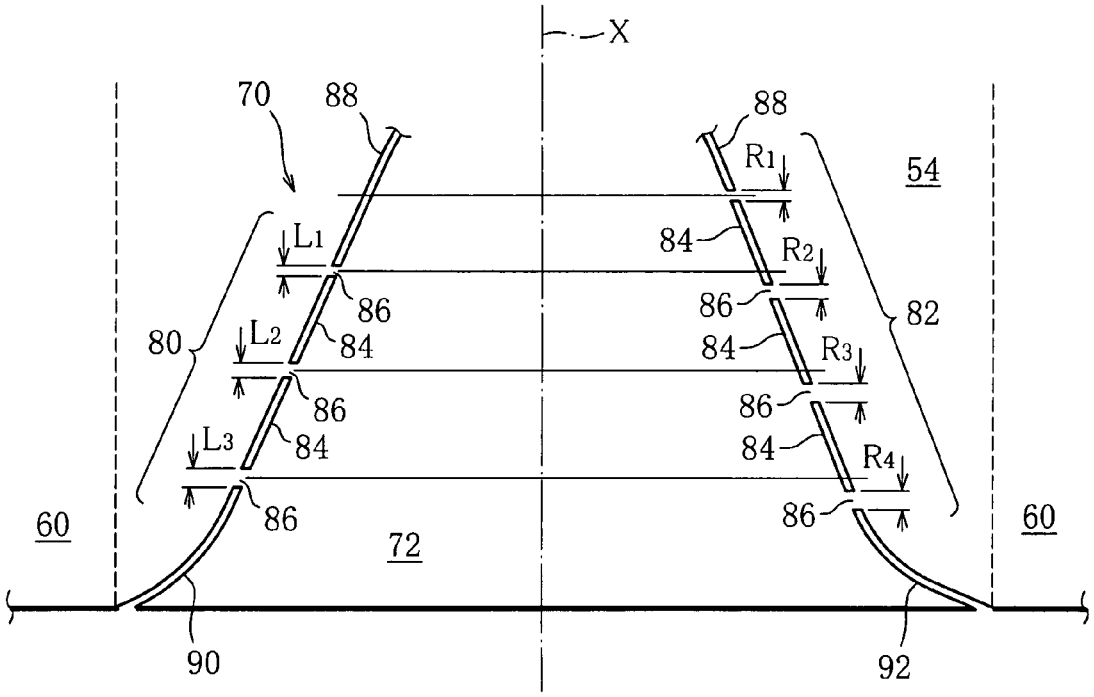
FIG. 9 is a view showing a part of a separation line that defines a to-be-cut-off portion in an enlarged scale.

FIG. 9 shows in an enlarged scale a part of the first separation line 70 that defines the to-be-cut-off portion 72 having the shape of substantial "U".

The to-be-cut-off portion 72 has a symmetric axis that coincides with a longitudinal axis of the outer box 2. The symmetric axis divides the to-be-cut-off portion 72 into two equal parts in a width direction. The first separation line 70 includes right- and left-side perforated lines 80 and 82 running straight. The perforated lines 80 and 82 are arranged symmetrically to each other with respect to the symmetric axis X. That is to say, the perforated lines 80 and 82 form an intermediate area of legs of the first separation line 70 having the shape of the letter U. The perforated lines 80 and 82 have a large number of perforations 84 and intermediate portions 86 between the perforations 84. The perforations 84 and the intermediate portions 86 are alternately arranged.

The U-shaped first separation line 70 further includes a base slit 88 forming a bottom portion thereof and end slits 90 and 92 forming distal end portions of the legs. The intermediate portions 86 are located between the base slit 88 and the perforated lines 80 and 82, and also between the perforated lines 80 and 82 and the end slits 90 and 92, respectively. In short, the perforated lines 80 and 82 have the intermediate portions 86 at both ends.

As is clear from FIG. 9, the end slits 90 and 92 open the lower edge of the front panel 54, and have a shape of a circular arc whose convex side faces inward in the width direction of the to-be-cut-off portion 72. The intermediate portions 86 of the perforated lines 80 and 82 are arranged asymmetrically, instead of symmetrically, with respect to the symmetric axis X. That is, when projected on the symmetric axis X, the intermediate portions 86 of the perforated lines 80 and 82 are alternately placed along the symmetric axis X. Stated differently, if there are line segments intersecting the symmetric axis X, the line segments crossing the perforated line 80 through the intermediate portions 86 thereof cross the perforated line 82 through the perforations 84 thereof instead of the intermediate portions 86.

In each of the perforated lines 80 and 82, the intermediate portions 86 located farther from the base slit 88 have proportionally long lengths. Accordingly, among the intermediate portions 86 of the perforated lines 80 and 82, the intermediate portion 86 adjacent to the base slit 88 has the shortest length. If the length of each of the intermediate portions 86 in the left-side perforated line 80 are denoted by $L_1$, $L_2$ and $L_3$ from the base slit 88 side, relationship can be expressed by $L_1<L_2<L_3$. Likewise, if the length of each of the intermediate portions 86 in the right-side perforated line 82 are denoted by $R_1$, $R_2$, $R_3$ and $R_4$ from the base slit 88 side, relationship can be expressed by $R_1<R_2<R_3<R_4$.

TABLE 1 specifically shows one example in respect of the length of the intermediate portions 86 and of the perforations 84 in the perforated lines 80 and 82. In TABLE 1, the intermediate portions and the cuts are shown by I and S, respectively.

TABLE 1

| | Right-side perforated line (unit: mm) | | | | | | | Left-side perforated line (unit: mm) | | | | |
|---|---|---|---|---|---|---|---|---|---|---|---|---|
| | I | S | I | S | I | S | I | I | S | I | S | I |
| Base-slit side | 0.35 | 2.7 | 0.4 | 2.7 | 0.6 | 2.7 | 0.65 | 0.4 | 3.5 | 0.6 | 3.5 | 0.65 |

As is obvious from FIG. 9, among the intermediate portions 86 in the perforated lines 80 and 82, the intermediate portion 86 (on the side of the right-side perforated line 82) having the length $R_1$ is the farthermost from the lower edge of the front panel 54. To put it differently, when the tongue-lid package is fabricated, the intermediate portion 86 having the length $R_1$ is the farthermost from the open end 4 of the outer box 2. For that reason, when the tongue 22 of the tongue lid 16 is first raised up from the front wall 20 of the outer box 2, that is, when the tongue-lid package is first opened, a separating force to the to-be-cut-off portion 72 is applied firstly to the intermediate portion 86 having the length $R_1$. As is apparent from TABLE 1, the length $R_1$ is the shortest of all the other lengths of the intermediate portions 86 in the right-side perforated line 82. Therefore, the intermediate portion 86 having the length $R_1$ is torn first as a fragile portion of the perforated line 82.

For the reason mentioned above, the separating force is subsequently applied to the intermediate portion 86 having the length $L_1$ among the intermediate portions 86 of the right-side perforated line 80. The length $L_1$ is the shortest of all the lengths of the intermediate portions 86 in the left-side perforated line 80. Consequently, the intermediate portion 86 having the length $L_1$ is torn next to the intermediate portion 86 having the length $R_1$.

Thereafter, the intermediate portions 86 of the perforated lines 82 and 80 are alternately torn in the same manner. The to-be-cut-off portion 72 is then accurately and cleanly detached from the front wall 20 of the outer box 2 along the first separation line 70. Therefore, when the tongue lid 16 is opened for the first time, the cut area 32 is reliably formed in the front wall 20 of the outer box 2 in a complete shape.

The base slit 88 and the end slits 90 and 92 may be partially or wholly replaced with perforated lines that carry out the same functions as the perforated lines 80 and 82.

Figure 10:
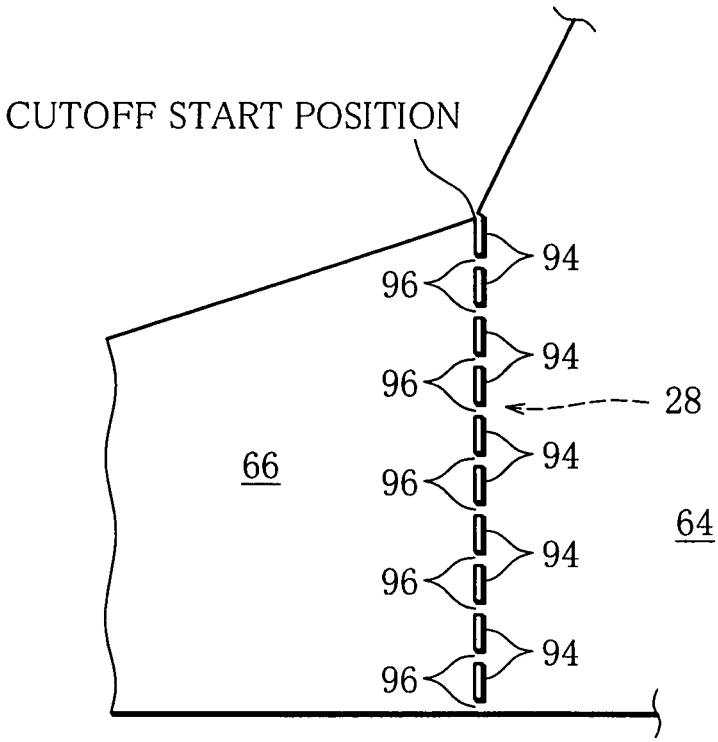
FIG. 10 is a view showing a separation line for a lug flap of FIG. 5 in an enlarged scale.

FIG. 10 shows one of the second separation lines 28 for the lugs 30 (lug flaps 66) in detail.

The second separation line 28 is also formed of a perforated line, which includes a plurality of perforations 94 and intermediate portions 96. The perforations 94 and the intermediate portions 96 are alternately arranged. When the tongue lid 16 is first opened, the separating force is first applied at one end (cutoff start position) of the perforated line 28 which is located on the side of the insertion tip 26 of the tongue lid 16 in FIG. 1, as illustrated in FIG. 10. A perforation 94 is located at the one end of the perforation line 28. At the other end of the perforated line 28, an intermediate portion 94 is located.

Figure 11:
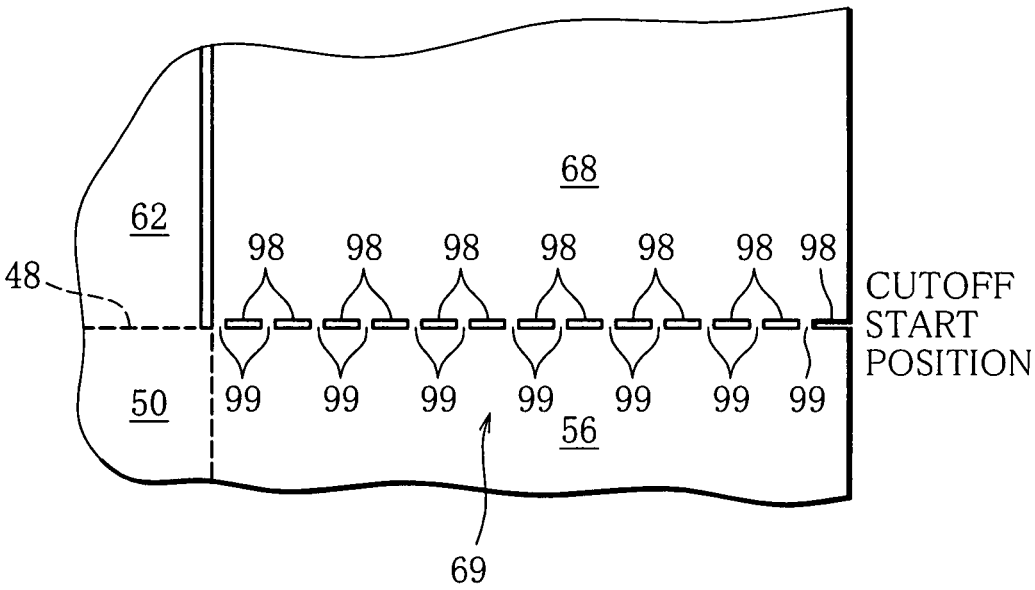
FIG. 11 is a view showing a separation line for an inner top flap of FIG. 5 in an enlarged scale.

FIG. 11 shows one of the third separation lines 69 for the inner top flaps 68 in detail.

The third separation lines 69 are also formed of a perforated line, which includes perforations 98 and intermediate portions 99 alternately arranged. When the tongue lid 16 is opened for the first time, the separating force applied at one end (cutoff start position) of the perforated line 69 adjacent to the front wall 20 of the outer box 2 in FIG. 1 is minimum. Therefore, a perforation 98 is located at the one end of the perforated line 69. In the other end of the perforated line 69, an intermediate portion 99 is located.

As described above, both the second and third separation lines (perforated lines) 28 and 69 have perforations in their cutoff start positions. Therefore, when the tongue lid 16 is opened for the first time, the intermediate portion 99 adjacent to the perforations at one end in each of the second and second separation lines 28 and 69 serves as a fragile portion, and is torn first. With the rupture of the intermediate portion 99 as a trigger, the lugs 30 and the inner top flaps 68 are reliably detached along the corresponding separation lines.

TABLES 2 and 3 specifically show one example of the lengths of the perforations and of the intermediate portions of the second and third separation lines 28 and 68. In TABLES 2 and 3, too, I and S represent the intermediate portions and the separations, respectively.

TABLE 2

| Perforations and intermediate portions of the second separation line (13 mm in length) | | | | | |
|---|---|---|---|---|---|
| | | | | | (Unit: mm) |
| Start position | S | 1.0 | ↓ | S | 0.9 |
| ↓ | I | 0.4 | ↓ | I | 0.4 |
| ↓ | S | 0.9 | ↓ | S | 0.9 |
| ↓ | I | 0.4 | ↓ | I | 0.4 |
| ↓ | S | 0.9 | ↓ | S | 0.9 |
| ↓ | I | 0.4 | ↓ | I | 0.4 |
| ↓ | S | 0.9 | ↓ | S | 0.9 |
| ↓ | I | 0.4 | ↓ | I | 0.4 |
| ↓ | S | 0.9 | ↓ | S | 0.9 |
| ↓ | I | 0.4 | End position | I | 0.3 |

TABLE 3

| Perforations and intermediate portions of the third separation line (21.25 mm in length) | | | | | |
|---|---|---|---|---|---|
| | | | | | (Unit: mm) |
| Start position | S | 1.45 | ↓ | S | 0.95 |
| ↓ | I | 0.25 | ↓ | I | 0.45 |
| ↓ | S | 1.10 | ↓ | S | 0.95 |
| ↓ | I | 0.25 | ↓ | I | 0.45 |
| ↓ | S | 1.10 | ↓ | S | 0.95 |
| ↓ | I | 0.35 | ↓ | I | 0.45 |
| ↓ | S | 1.00 | ↓ | S | 0.95 |
| ↓ | I | 0.35 | ↓ | I | 0.45 |
| ↓ | S | 1.00 | ↓ | S | 0.95 |
| ↓ | I | 0.35 | ↓ | I | 0.45 |
| ↓ | S | 1.00 | ↓ | S | 0.95 |
| ↓ | I | 0.45 | ↓ | I | 0.45 |
| ↓ | S | 0.95 | ↓ | S | 0.95 |
| ↓ | I | 0.45 | End position | I | 0.45 |

As is clear from TABLES 2 and 3, in both the second and third separation lines 28 and 69, the perforations 94 and 98 located at the respective cutoff start positions are the longest of all other perforations. Accordingly, when the tongue lid 16 is first opened, the separating force is intensively applied to the intermediate portions adjacent to the respective perforations at the cutoff start positions. Therefore, the lugs 30 and the inner top flaps 68 are reliably and stably detached along the second and third separation lines 28 and 69. Particularly in the case of each of the third separation lines 69 of the inner top flaps 68, the intermediate portion 99 adjacent to the perforation 98 at the cutoff start position and the intermediate portion 99 next to this intermediate portion is shorter in length than the other intermediate portions. Therefore, the inner top flaps 68 are easily torn, which significantly reduces resistance generated when the tongue lid 16 is first opened.

The present invention is not limited to the above embodiment and may be modified in various ways.

For instance, the invention can be applied not only to the tongue-lid package but to conventional hinge-lid packages. In this case, the separation line 70 of the invention may be formed in an inner frame forming a part of the outer box in the hinge-lid package. When the hinge lid is opened for the first time, a part of the inner frame is detached along the first cut line 70, which forms a substantially U-shaped cut area.

Figure 12:
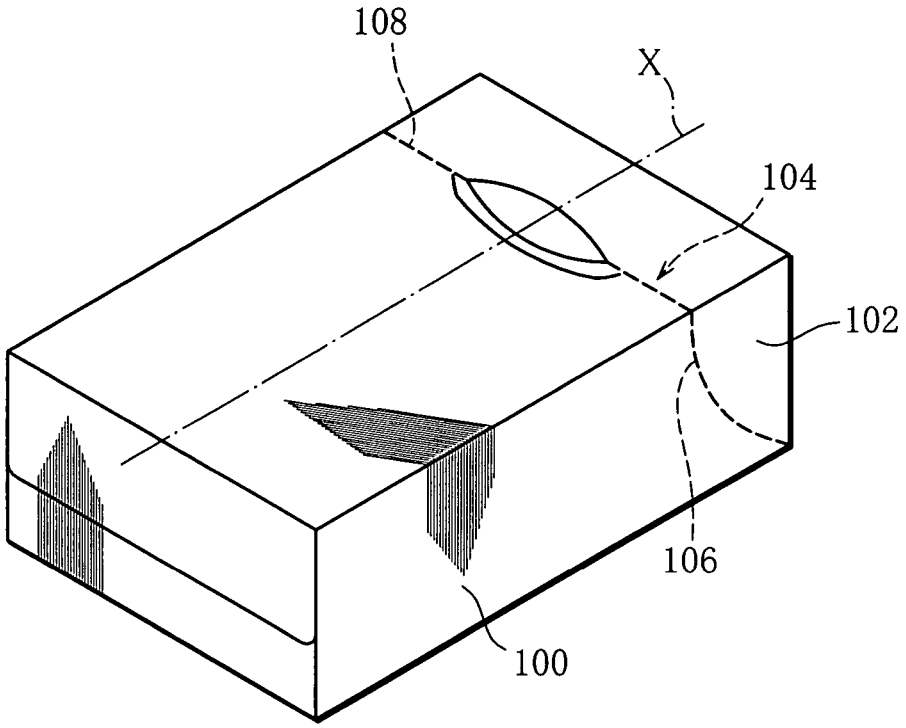
FIG. 12 is a view showing a hinge-lid package of another embodiment.

A separation line 104 of the invention applied to a hinge-lid package shown in FIG. 12 is used to detachably connect an outer box 100 of the package and a hinge lid 102 of the package to each other. In this case, the separation line 104 includes right- and left-side perforated lines 106 and 108. The perforated lines 106 and 108 are arranged on the right and left sides with respect to a symmetric axis X running in the center as viewed in a width direction of the hinge lid 102. The right- and left-side perforated lines 106 and 108 have a plurality of perforations and intermediate portions. The intermediate portions of the perforated lines 106 and 108 are disposed asymmetrically to the symmetric axis X as with the intermediate portions of the perforated lines 80 and 82 shown in FIG. 9. In other words, when the intermediate portions of the perforated lines 106 and 108 are aligned on a collinear line intersecting the symmetric axis X according to distance between the respective positions thereof and the symmetric axis X, the intermediate portions of the perforated lines 106 and 108 are alternately located on the collinear line.

The hinge-lid package of FIG. 12 has an aperture 110 on the symmetric axis X. By hooking a finger in the aperture 110, the user can open the hinge lid 102. At this time, the hinge lid 102 is accurately and cleanly detached from the outer box 100 along the perforated lines 106 and 108.

The invention claimed is:

1. A hinge-lid package for rod-shaped smoking articles comprising:

an outer box having an open end;

an inner pack contained in said outer box, said inner pack including a bundle of the rod-shaped smoking articles and an inner wrapper wrapping the bundle; and a lid hingedly jointed to a rear edge of the open end of said outer box, and for opening and closing the open end, said lid including a tongue superposed upon a front wall of said outer box, wherein the front wall includes a first separation line demarcating a to-be-cut-off portion which is bonded to an inner surface of the tongue immediately after the hinge-lid package is fabricated, the to-be-cut-off portion being substantially U shaped and including a front edge of the open end and a center axis;

said first separation line includes a pair of perforated lines forming a part of straight lateral sides of the U-shaped to-be-cut-off portion, the perforated lines extending along the center axis and having perforations and intermediate portions between the perforations, a base slit forming a bottom of the U-shaped to-be-cut-off portion and extending across the center axis, and two connection joints located at a distance from each other with the center axis therebetween and left between the base slit and each of the perforated lines; and one of the connection joints is formed as a fragile portion in the first separation line, the fragile portion has a length shortest among the intermediate portions of the first separation line and the other connection joint, so that the fragile portion determines a cutoff start position of the first separation line where cutting of the first separation line starts when said lid is first opened due to a raise of the tongue of said lid, and the other of the connection joints has a length longer than that of the fragile portion and shorter than that of the intermediate portions included in the perforated line that is located at the other of the connection joints, so that the other of the connection joints determines a cutoff position to be torn next to the fragile portion in the first separation line.

2. The hinge-lid package according to claim 1, wherein:

the intermediate portions of the pair of perforated lines are arranged asymmetrically to each other with respect to a center axis of the U-shaped to-be-cut-off portion enabling the intermediate portions of the perforated lines to be alternatively torn after the other of the connection joints has been torn.

3. The hinge-lid package according to claim 1, wherein:

the intermediate portions of the perforated lines have lengths that are increased as distances between positions thereof and the base slit are increased.

4. The hinge-lid package according to claim 2, wherein:

said lid further includes a pair of lugs superposed upon and bonded to both side walls of said outer box immediately after the hinge-lid package is fabricated, and a second separation line for detachably connecting the lugs and said lid.

5. The hinge-lid package according to claim 2, wherein:

said outer box further includes a pair of inner top flaps superposed upon and bonded to the inner surface of said lid immediately after the hinge-lid package is fabricated, and a third separation line for detachably connecting the inner top flaps to both side edges of the open end of said outer box.

6. A blank for forming said outer box and said lid claimed in claim 2.

* * * * *